US005768041A

United States Patent [19]

Rudolph

[11] Patent Number: 5,768,041

[45] Date of Patent: Jun. 16, 1998

[54] RETRACTABLE REFLECTIVE DEVICE FOR A BACKPACK OR CHILD CARRIER

[75] Inventor: Mark H. Rudolph, Denver, Colo.

[73] Assignee: Rear View LLC, Denver, Colo.

[21] Appl. No.: 768,608

[22] Filed: Dec. 18, 1996

[51] Int. Cl.[6] ..... G02B 7/182

[52] U.S. Cl. ..... 359/872; 359/879; 359/881

[58] Field of Search ..... 359/516, 519, 359/841, 871, 872, 879, 880, 881, 882; 224/576, 160, 161, 162, 269

[56] References Cited

U.S. PATENT DOCUMENTS

| | | | |
|---|---|---|---|
| 439,001 | 10/1890 | Greenwood | 359/879 |
| 2,709,393 | 5/1955 | Anderson | 359/519 |
| 2,732,148 | 1/1956 | Lummis | 242/107 |
| 3,377,880 | 4/1968 | Carter, Jr. | 359/841 |
| 3,730,612 | 5/1973 | Arroyo et al. | 359/881 |
| 4,024,828 | 5/1977 | Knoll et al. | 359/516 |
| 4,286,840 | 9/1981 | Covert | 350/289 |
| 4,359,266 | 11/1982 | Rohlf et al. . | |
| 4,702,572 | 10/1987 | Cossey . | |
| 4,858,797 | 8/1989 | Rabska | 224/162 |
| 4,909,618 | 3/1990 | Gardner | 350/623 |
| 4,934,302 | 6/1990 | Fluharty et al. | 350/604 |
| 4,934,528 | 6/1990 | Miller et al. | 206/235 |
| 4,982,926 | 1/1991 | Mori et al. | 248/479 |
| 4,989,964 | 2/1991 | Meise | 350/616 |
| 5,124,847 | 6/1992 | Gong | 359/854 |
| 5,285,321 | 2/1994 | Nolan-Brown | 359/871 |
| 5,375,014 | 12/1994 | Fujie et al. | 359/841 |

*Primary Examiner*—Ricky D. Shafer
*Attorney, Agent, or Firm*—Sheridan Ross P.C.

[57] ABSTRACT

An apparatus for attachment or integral interconnection to a backpack or child carrier which permits the user of the backpack or child carrier to quickly view rearward while maintaining a line of sight in a forward direction, thus permitting the monitoring of a child riding in the childcarrier or other activity occurring behind the user of the backpack.

15 Claims, 2 Drawing Sheets

RETRACTABLE REFLECTIVE DEVICE FOR A BACKPACK OR CHILD CARRIER

FIELD OF INVENTION

This invention relates to a retractable reflective device which allows the user of a backpack or child carrier to look rearward while maintaining a line of sight in a forward direction, thus permitting the monitoring of a child riding in the childcarrier or the viewing of others positioned behind the user of the backpack.

BACKGROUND OF THE INVENTION

Many, if not all users of backpack childcarriers experience the same uselessness of attempting to view ones child while wearing a childcarrier backpack. In the past people have had to rely on removing ones sunglasses and attempting to strain to see a convoluted image of their brood, or to remove the child carrier entirely to monitor the childs' condition and state of being. Alternatively, others carried mirrors in their pockets only to fumble while removing them and replacing them, while posing a safety risk by carrying glass or a sharp edged reflective surface in a pocket of a coat or trousers.

SUMMARY OF THE INVENTION

Accordingly, it is an object of the present invention to provide a device for easily and conveniently viewing a child while the child is in a child carrier backpack while the user is looking in a forward direction. It is a further object of the present invention to provide a device that is inexpensive, non-obstructive and readily available for use, which can be operated omnidirectionally from a fixed location and which can be removably attached to a backpack or child carrier or built into the structure of the backpack or child carrier. Finally, it is intended that the object can be used not only to view a child riding in a child carrier but by anyone wearing a backpack to allow the individual to look rearwardly while travelling or looking in a forward direction.

DETAILED DESCRIPTION

Figure 1:
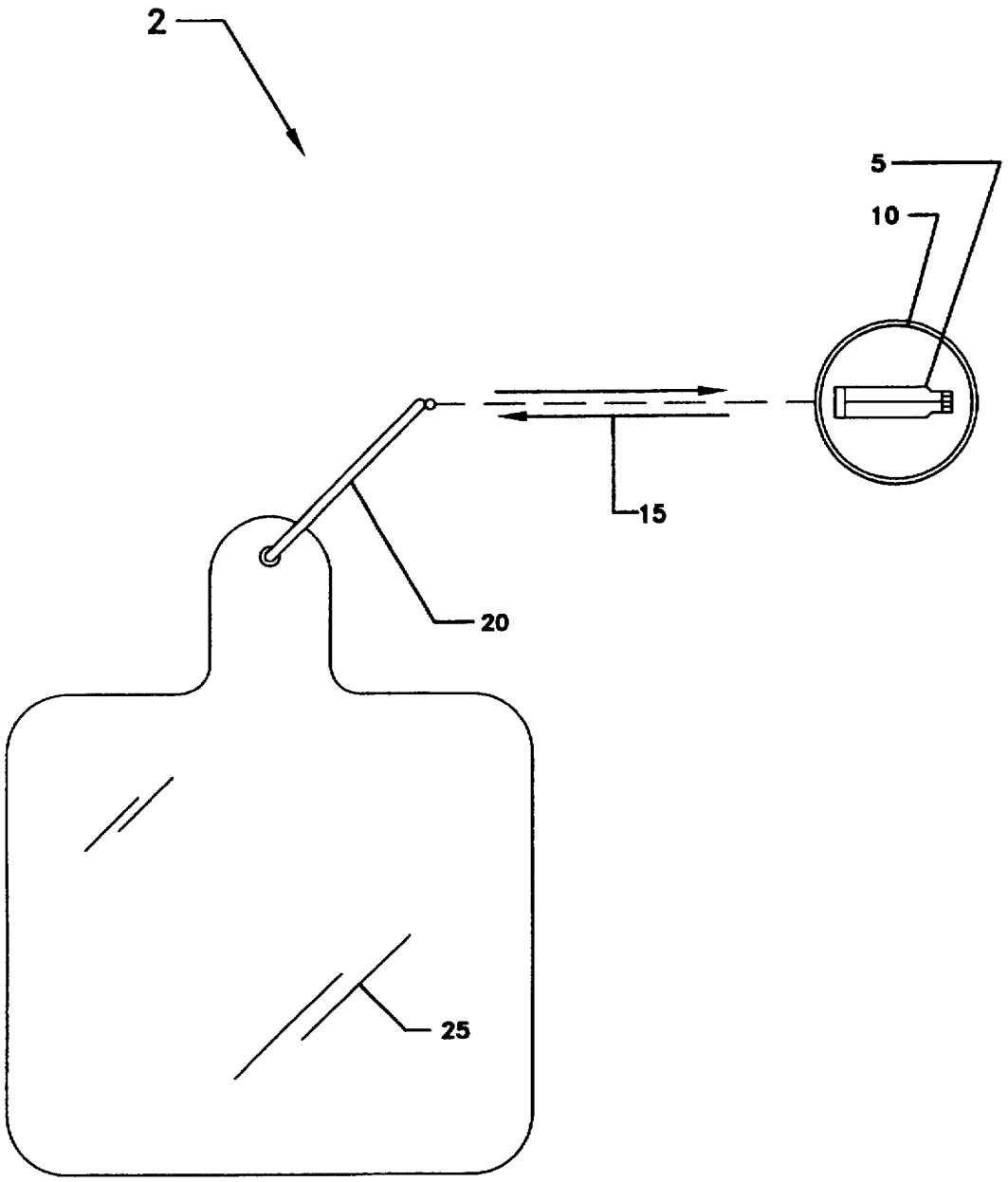
FIG. 1 is a plain view of the components comprising a retractable reflective device for removable attachment to a backpack or child carrier.

Referring now to the drawings, FIG. 1 shows a retractable reflective device 2 according to one embodiment of the present invention. The retractable reflective device 2 is generally comprised of an interconnection clip 5 in one embodiment which is attached to a retractable reel or spool 10, which acts as a housing for a specified length of attachment line or cord 15. The retractable spool 10 is attached to a release clip 20, for attachment to a mirror or reflective device 25, to allow the user to look in a rearward direction while maintaining a line of sight in a forward direction, thus permitting the monitoring of a child riding in a childcarrier.

The retractable reflective device 25 is easily mounted in place and used for omnidirectional operation from a fixed location. The interconnection clip 5, is located on one side of the retractable reel or spool 10, and is attached to the shoulder strap or other accessible portion of the backpack or child carrier. Once this is completed, a reflective device 25 such as a mirror can be withdrawn from it resting place with the attachment line 15, for viewing in a rearward direction. The reflective device 25 will automatically return to place by the retracting motion of the retractable spool or reel 10.

The retractable spool 10 in one embodiment may be a one inch diameter reel comprised of a metal or plastic casing. Similar retractable spools 10 are also available in black, chrome, gold, brass, or various colors as defined by any manufacturer. The retractable spools 10 are available in sizes ranging from less than one inch in diameter to three to four inches in diameter. The construction can be of metal, plastic, fiberglass or any combination or similar type of material. The manufacturer of one type of retractable spool 10 used for the present invention is United Meiho (H.K.) Limited of Hong Kong.

The attachment line 15 is generally made of nylon string, twine, cord, or plastic approximately 18 inches long. Similar attachment lines 15 are also available in plastic or string comprised of natural or synthetic materials, metal wire with or without a plastic coating, or a metal or plastic chain. The attachment line 15 may be in lengths ranging from approximately four inches to 36 inches long, but more preferably is approximately 12 to 16 inches in length to permit a significant extension in length for optimal viewing.

The interconnection means 5 in one embodiment is a safety clip which is attached to one side of the retractable spool 10, for removable interconnection of the retractable spool 10 to a backpack or child carrier. Similar interconnection means 5 are also available as a hook and loop type material such as velcro®, a clip, or constructed within an integral portion of the backpack or child carrier such as the shoulder strap to allow for use of the retractable spool 10. The interconnection clip 5, may be attached to the retractable spool 10 with a rivet type device in the center of the spool, or alternatively by the use of glue or other commonly known adhesives. Furthermore, the retractable spool 10 may be positioned within the backpack shoulder strap material during manufacturing to alleviate the need for any type of interconnection means altogether.

The reflective device 25, in one embodiment is a flexible mirror preferably made of shatterproof plastic. A handle to ease the holding of the reflective device 25 may also be present, but is not a requirement of the invention. Similar reflective devices 25, are also available such as a glass mirror, cardboard reflective surface, metal reflective surface, or plastic reflective surface. Various different shapes of the reflective device 25, are available as well as shapes for the handle of the reflective device 25. One manufacturer of the reflective device 25 in a preferred embodiment of the present invention is Bunker Plastics in Grand Saline, Tex.

Figure 2:
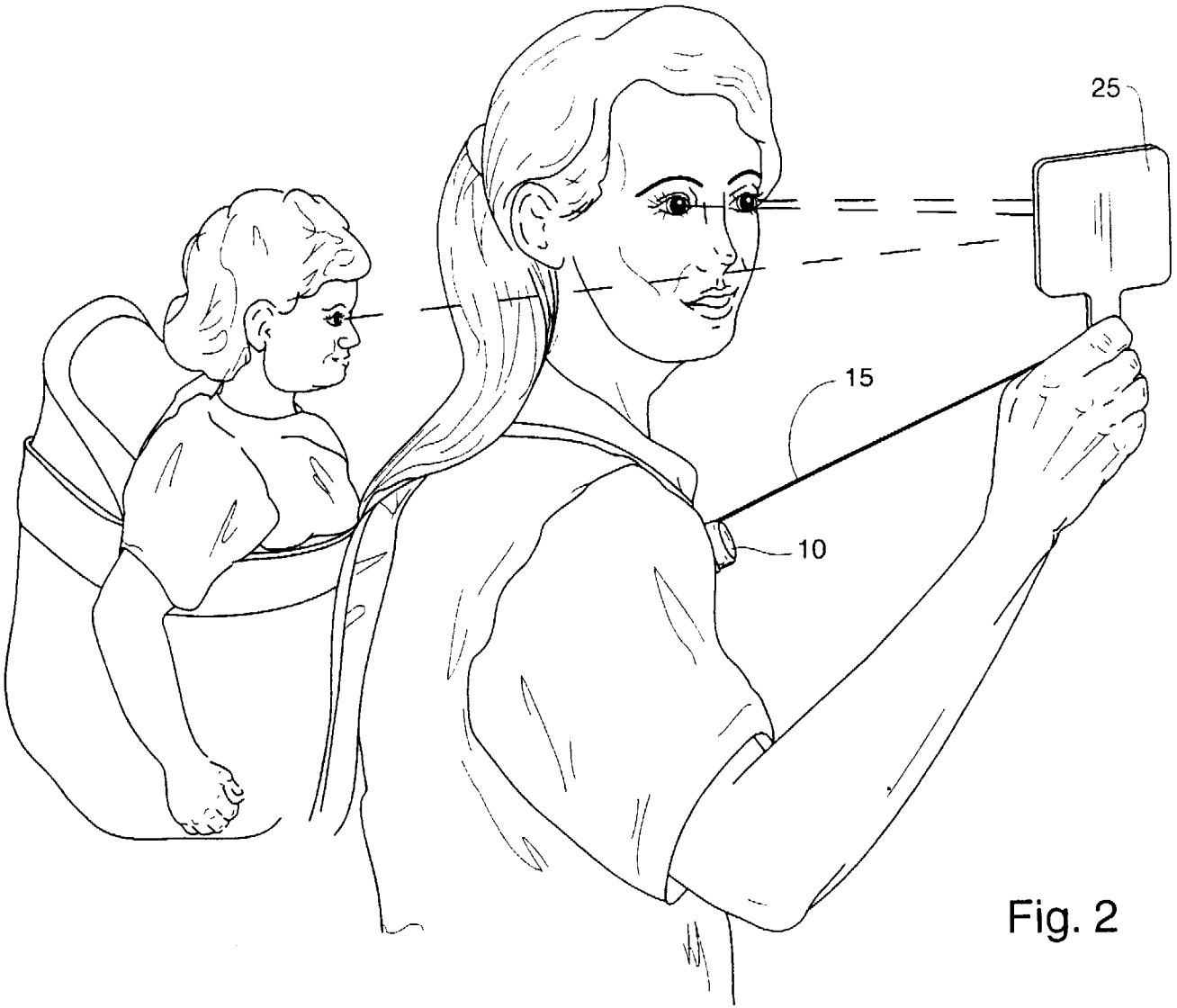
FIG. 2 is a perspective view of the retractable mirror assembly shown in use, with environment.

In use as seen in FIG. 2, the reflective device 25 is used by attaching the interconnection clip 5 or other interconnection means to the shoulder strap or other convenient portion of the backpack or child carrier. The user then pulls on the reflective device 25 to the desired length thus extending the attachment line 15. The user then is able to view rearwardly while maintaining a line of sight in a forward direction, thus permitting the monitoring of a child riding in a childcarrier. The reflective device 25 is then slowly released to allow the attachment line 15 to retract into the retractable spool 10, and hence securing the reflective device 25 in close proximity to the interconnection clip 5.

For clarity purposes, the following components and associated numbering is provided herein.

| No. | Component |
|---|---|
| 2 | retractable reflective device |
| 5 | interconnection clip |
| 10 | retractable reel or spool |
| 15 | attachment line |
| 20 | release clip |
| 25 | reflective device |

While various embodiments of the present invention have been described in detail, it is apparent that modifications and adaptations of these embodiments will occur to those skilled in the art. However, it is to be expressly understood that such modifications and adaptations are within the spirit and scope of the present invention.

I claim:

1. A retractable reflective device for removable attachment and use in combination with a backpack or childcarrier comprising:

(a) a reflective object having at least one planar surface to permit viewing in a substantially rearward direction opposite a users' forward line of sight;

(b) an attachment line having first and second ends, said first end interconnected to said reflective object;

(c) retractable attachment line storage means interconnected to said second end of said attachment line, said storage means having a first retracted position wherein said attachment line is retracted and stored in a non-extended position and a second extended position wherein said attachment line may be extended outwardly by a user wearing said backpack or said childcarrier a sufficient distance to permit viewing of said reflective object; and (d) interconnection means for removably attaching said retractable attachment line storage means to said backpack or said childcarrier.

2. The retractable reflective device of claim 1, wherein said attachment line is comprised of string, wire, chain, twine, plastic, rubber, or combinations thereof.

3. The retractable reflective device of claim 1, wherein said reflective object is a mirror.

4. The retractable reflective device of claim 1, wherein said interconnection means is a safety pin.

5. The retractable reflective device of claim 1, wherein said interconnection means is a clip.

6. The retractable reflective device of claim 1, wherein said interconnection means is a hook and loop type material for interconnection to an opposing hook and loop type material attached to said backpack.

7. The retractable reflective device of claim 1, wherein said retractable attachment line storage means comprises a spring biased spool which is in a biased position when said attachment line is extended away from said retractable attachment line storage means.

8. The retractable reflective device of claim 1, wherein said reflective object further comprises a handle for grasping by a user's hand.

9. The retractable reflective device of claim 1, further comprising a release clip interconnected to said first end of said attachment line, wherein said first end of said attachment line may be releasably interconnected to said reflective object.

10. A retractable reflective device interconnected to a backpack or childcarrier, comprising:

(a) a reflective object having at least one planar surface to permit viewing in a substantially rearward direction opposite a users' forward line of sight;

(b) an attachment line having first and second ends, said first end interconnected to said reflective object; and (c) retractable attachment line storage means interconnected to said backpack or said child carrier at a location which permits the user of said backpack or said child carrier to grasp said reflective object during use, said retractable attachment line storage means further interconnected to said second end of said attachment line, said storage means having a first retracted position wherein said attachment line is retracted and stored in a non-extended position, and a second extended position wherein said attachment line may be extended outwardly a sufficient distance to permit a user wearing said backpack or said childcarrier to view said reflective object.

11. The retractable reflective device of claim 10, further comprising a release clip interconnected to said first end of said attachment line and said reflective object, wherein said first end of said attachment line may be releasably interconnected to said reflective object.

12. The retractable reflective device of claim 10, wherein said attachment line is comprised of string, wire, chain, twine, plastic, rubber, or combinations thereof.

13. The retractable reflective device of claim 10, wherein said reflective object is a mirror.

14. The retractable reflective device of claim 10, wherein said retractable attachment line storage means comprises a spring biased spool which is in a biased position when said attachment line is extended away from said retractable attachment line storage means.

15. The retractable reflective device of claim 10, wherein said reflective object further comprises a handle for grasping by a user's hand.

* * * * *